US008230880B2

(12) United States Patent
Srivastava et al.

(10) Patent No.: US 8,230,880 B2
(45) Date of Patent: Jul. 31, 2012

(54) ARRANGEMENTS FOR PUMPING FLUIDS FROM SUMPS

(75) Inventors: Ramesh Kumar Srivastava, Pune (IN); Jagadish Trimbak Kshirsagar, Pune (IN); Shyam Narayan Shukla, Pune (IN)

(73) Assignee: Kirloskar Brothers Limited, Pune (IN)

( * ) Notice: Subject to any disclaimer, the term of this patent is extended or adjusted under 35 U.S.C. 154(b) by 418 days.

(21) Appl. No.: 12/516,054

(22) PCT Filed: Nov. 23, 2007

(86) PCT No.: PCT/IN2007/000554

§ 371 (c)(1),
(2), (4) Date: May 22, 2009

(87) PCT Pub. No.: WO2008/062482

PCT Pub. Date: May 29, 2008

(65) Prior Publication Data

US 2010/0051127 A1 Mar. 4, 2010

(30) Foreign Application Priority Data

Nov. 24, 2006 (IN) ..... 1941/MUM/2006

(51) Int. Cl.
*E03B 11/00* (2006.01)

(52) U.S. Cl. ..... 137/590

(58) Field of Classification Search ..... 137/565.17, 137/565.37, 590, 803, 356, 363, 372, 377
See application file for complete search history.

(56) References Cited

U.S. PATENT DOCUMENTS

| | | | | |
|---|---|---|---|---|
| 2,193,466 | A * | 3/1940 | Raymond | 137/590 |
| 2,939,481 | A * | 6/1960 | Hobson | 137/590 |
| 3,854,526 | A * | 12/1974 | Cole et al. | 165/71 |
| 6,681,801 | B2 * | 1/2004 | Hoehn et al. | 137/565.17 |

FOREIGN PATENT DOCUMENTS

| | | |
|---|---|---|
| JP | 2002-348838 | 12/2002 |
| JP | 2002348838 A * | 12/2002 |

* cited by examiner

*Primary Examiner* — Dinh Q Nguyen
*Assistant Examiner* — Viet Le
(74) *Attorney, Agent, or Firm* — Robert P. Michal; Lucas & Mercanti, LLP

(57) ABSTRACT

An arrangement for drawing fluid from a sump (10), comprising a pump (24), a draft tube (12) extending from the pump (24), into the sump (10), said draft tube (12) having an opening within the sump (10) and a canopy defined by roof and side walls surrounding said opening.

10 Claims, 5 Drawing Sheets

ARRANGEMENTS FOR PUMPING FLUIDS FROM SUMPS

FIELD OF INVENTION

The present invention relates to arrangements for pumping fluids from sumps.

DEFINITION

In the specification unless or otherwise provided, the following terms shall have the meanings assigned to them, in addition to their ordinary dictionary meaning, Air entraining vortices—The term air entraining vortices refers to vortices that carry cavitation causing voids or air bubbles in a liquid which rapidly collapses, producing a shock wave, thereby causing damage to the impellers of a suction pump.

Cavitation—The term cavitation is used to describe the behavior of voids or bubbles in a liquid. Cavitation is usually divided into two classes of behavior: inertial (or transient) cavitation and non-inertial cavitation. Inertial cavitation is the process where a void or bubble in a liquid rapidly collapses, producing a shock wave.

Draft tube—The term draft tube refers to the tube carrying a liquid such as water from a vessel or body of water such as a sump, below the intake of a suction pump to the pump itself.

Submergence—The term submergence refers to the level of water present in a sump.

Sump—The term sump refers to a space in which liquids such as water or chemicals collect, e.g. a reservoir, tank or a flowing water stream Vortex—The term vortex refers to the motion of the fluid swirling rapidly around a center.

BACKGROUND OF THE PRESENT INVENTION

A sump is a reservoir in which water is stored or collected. Therefore, sumps could be in the form of water tanks, ponds, lakes or any other natural or artificial water body. Water is removed from the sump with the help of a pump, typically a sump pump, which can be a centrifugal pump, a reciprocating pump, a pedestal pump, a submersible pump, an ejector pump and the like. The pump is usually installed in a pit which is dug to a level that is close to bed of the sump. Generally a draft tube is provided at the inlet of the pump for directing water from the sump. After the pump is started, due to a pressure differential at both ends of the draft tube, water is drawn from the sump into the draft tube towards the inlet of the pump. As the water is pumped, the water level in the sump starts decreasing. The suction force creates vortices in the water mass in the sump. When the water reaches a certain submergence level, the critical submergence, due to the suction force exerted by the pump the surface of the water is broken, allowing atmospheric air to be sucked into the mass of the water and particularly the vortices. This air enters the draft tube in the form of voids and bubbles. This phenomenon is called air entrainment. The air entrainment imparts uneven loading on the impeller eye of the pump, effecting vibrations in the pump, thereby causing the pump to de-prime.

In order to avoid air entrainment damaging the different parts of the pump, a close monitoring over the submergence level is inevitable. Therefore, when the submergence level comes down to a point where air entrainment begins, the pump is required to be shut down. This monitoring can be achieved by physically measuring the critical submergence level and then shutting the pump when critical submergence level is reached or by employing sensors or floating switches that automatically shut down the pump at the critical submergence level. The water below the critical submergence level cannot be pumped which leads to wastage of that water due to non-usability.

PRIOR ART

In the prior art, to guard against air entrainment various devices have been suggested. A floating raft/buoy is placed on the surface of the sump. Since this raft floats on the surface of water, it gets lowered in the sump as water gets pumped. This raft reduces the air entrainment to a certain extent. However, the nature of the floating raft and the fact that it is floating does not fully eliminate the problem of air entrainment. The raft may literally float away or get dislodged from its position and therefore this raft needs continuous observation.

Another method recommended is to excavate the bed and to effectively lower the level of the inlet to the draft tube in relation to the bed or base of the reservoir in order meet with the submergence required. This method is however expensive & requires additional steps for the construction of the system.

U.S. Pat. No. 4,576,197 describes a suction pump vortex control system in which a wall is extended down from the top of the pumping chamber enclosure on the reservoir side to slightly below the low water elevation in order to form a fluid seal. This seal prevents the entrance of atmospheric air leakage into the pumping chamber. The atmospheric air in the pumping chamber is removed to induce a vacuum so that the fluid level in the pumping chamber rises which depends mainly on the difference between the vacuum pressure and the atmospheric pressure. Therefore, this system requires not only the construction of a wall, but also means to dynamically remove the atmospheric air from the pumping chamber. This makes the system not only expensive but a volume of the sump area is occupied by the wall and the vacuum creating device.

OBJECT OF THE PRESENT INVENTION

An object of the present invention is to provide for a pump and sump arrangement having means to avoid air entrainment.

A further object in accordance with the present invention is to provide for a pump and sump arrangement that involves no excavation of the bed of the sump, thereby reducing cost for the same.

A further object in accordance with the present invention is to provide for a pump sump arrangement that involves no construction of wall or any other civil/construction work, thereby reducing the maintenance and costs involved.

A still further object of the present invention is to minimize the time loss due to stoppage of pumping activity when the pump is switched off when the critical submergence level is reached in the sump.

A still further object of the present invention is to minimize the need to monitor the submergence level by providing an alternate arrangement for the sensors or the floating switches which are usually employed.

A still further object of the present invention is to provide a pump and sump arrangement which is economical, safe and easy to maintain.

SUMMARY OF THE PRESENT INVENTION

According to this invention there is provided an arrangement for drawing fluid from a sump, comprising a pump, a draft tube extending from the pump into the sump, said draft tube having an opening within the sump and a canopy defined by roof and side walls surrounding said opening.

Particularly, the opening has a maximum height of 'x' above the bed of the sump and the canopy extends into the sump from the opening to a distance of at least 0.5x and typically between a distance of 0.5x and 3x and the height of the roof of the canopy as measured from the base of the sump ranges between x and 1.2x.

In accordance with one embodiment of the invention, the canopy is integral with the draft tube.

Alternatively, the canopy and the draft tube are separate elements in which case the canopy is either fitted to the draft tube or to the wall of the sump defining the opening.

Typically, the canopy extends from the wall of the sump in which the opening is defined.

The roof of the canopy may be defined in a plane which is at an angle between 0 and 30 degrees with respect approximately to the plane of the sump bed.

The side walls may be parallel or inclined to the roof and the roof and side walls are rectangular or trapezoidal elements.

The invention also extends to a draft tube for a pump for drawing liquids from a pump, characterized in that the draft tube has a canopy defined by a roof and side walls adapted to extend into a sump up to a distance of 0.5x to 3x, where x represents the maximum height of an opening of the draft tube from the sump bed and the roof has a height ranging from x to 1.2x.

Typically, the canopy is made from at least one material selected from a group of materials consisting of, metal, meshed reinforced ferro concrete, cast in-situ with ferro concrete, mild steel (all grades), stainless steel 316 and masonary.

BRIEF DESCRIPTION OF THE ACCOMPANYING DRAWINGS

The present invention will now be described with reference to accompanying drawings, and said drawings do not limit the scope of the invention in way but merely illustrates the same. In the accompanying drawings.

DETAILED DESCRIPTION OF THE ACCOMPANYING DRAWINGS

Figure 1:
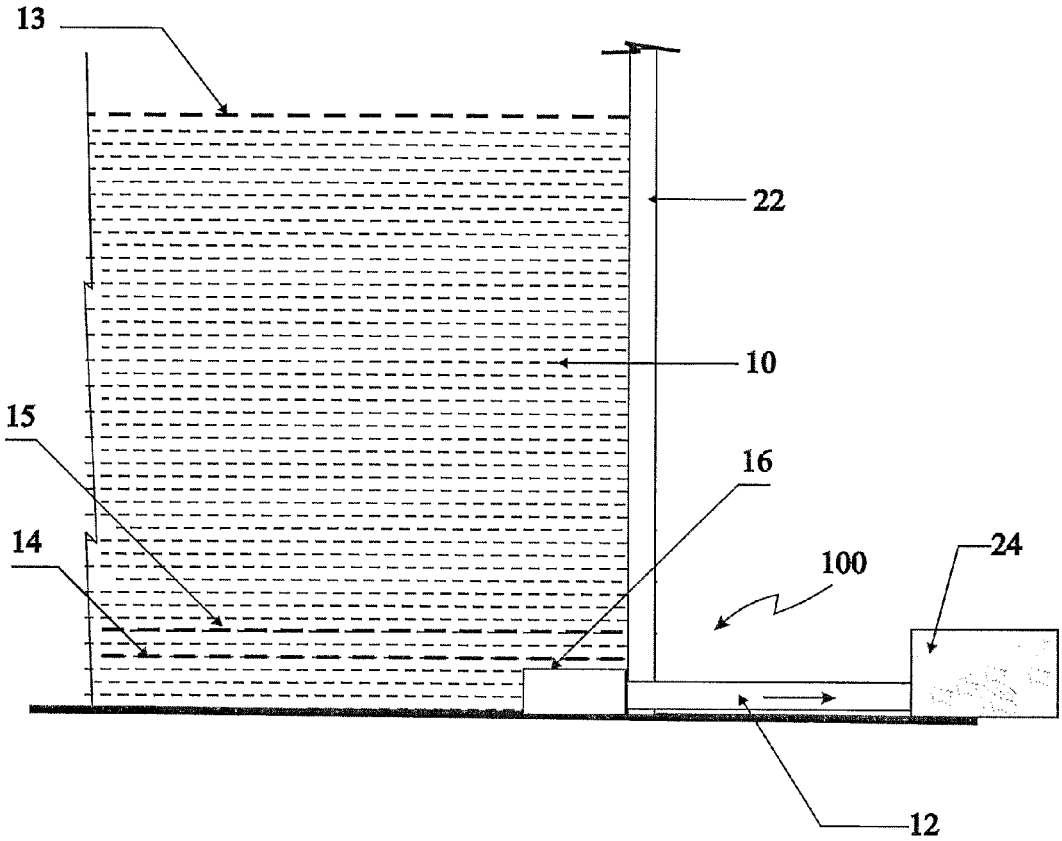
FIG. 1 shows schematic view of the arrangement in accordance with this invention.

Referring to the drawings an arrangement for drawing fluid from a sump, comprising a pump, a draft tube extending from the pump into the sump, said draft tube having an opening within the sump and a canopy defined by roof and side walls surrounding said opening is indicated generally by reference numeral (100).

The arrangement 100 comprises a pump 24, fitted with a draft tube 12. The arrangement 100 can be used for drawing fluid typically water from a sump (10).

In the drawings, the arrangement is not depicted to scale and has been provided for an understanding of the invention and does not in any way limit the invention. The arrangement 100 also includes a canopy 16 fitted around an opening 11 in a side wall 22 of the sump 10 typically seen in FIGS. 2, to 5 of the drawings. The pump 24 is typically a suction pump. The draft tube (12) defines a central axis and an opening in the wall 22 of the sump (10). After the pump 24 is started, due to a pressure differential at both ends of the draft tube 12, water is drawn from the sump (10), through the opening (11) into the draft tube (12). As the water is pumped, the water level (13) in the sump (10) starts decreasing. The suction force creates vortices in the water mass in the sump (10). When the water reaches a certain submergence level, the critical submergence level (15), due to the suction force exerted by the pump the surface of the water is broken, allowing atmospheric air to be sucked into the mass of the water and particularly the vortices. In the absence of the canopy 16, this air enters the draft tube (12) in the form of voids and bubbles at a critical submergence level 15. This phenomenon is called air entrainment. The air entrainment imparts uneven loading on the impeller eye of the pump, effecting vibrations in the pump, thereby causing the pump to de-prime.

To improve the aforesaid phenomenon, in accordance with this invention, the canopy (16) or a baffle like structure is fixed by standard means or integrated as an extension to the draft tube (12). The opening (11) is at a maximum height 'x' as measured from the bed of a sump (10). The canopy (16) is defined by a roof element (18) & side walls (20) spaced apart from and extending along the central axis of the draft tube (12), up to a length between '½ x' and '3.0 x' and at a height ranging from 'x' to '1.2 x', thereby contouring the opening (11) of the draft tube (12) in the sump (10) and lowering the submergence level to a level 14 at which air entraining vortices enter the draft tube (12). Beyond 3x the critical submergence level remains the same and is not further lowered. If the opening is at one end of the sump bed, the canopy can have a roof element and one side element, since the other side wall is effectively the wall of the sump.

Figure 3:
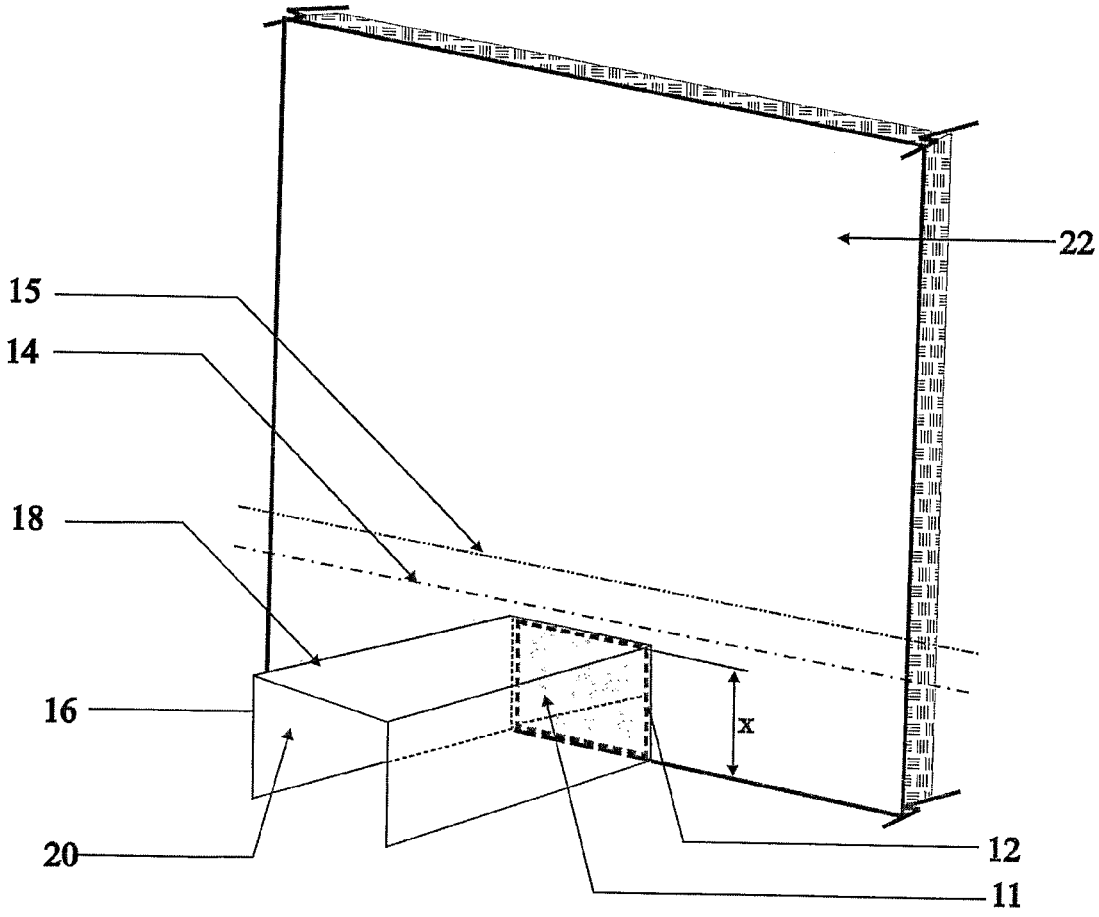
FIG. 3 shows the perspective view of an alternative canopy and draft tube arrangement for a sump in which the canopy extends from the draft tube.
Figure 4:
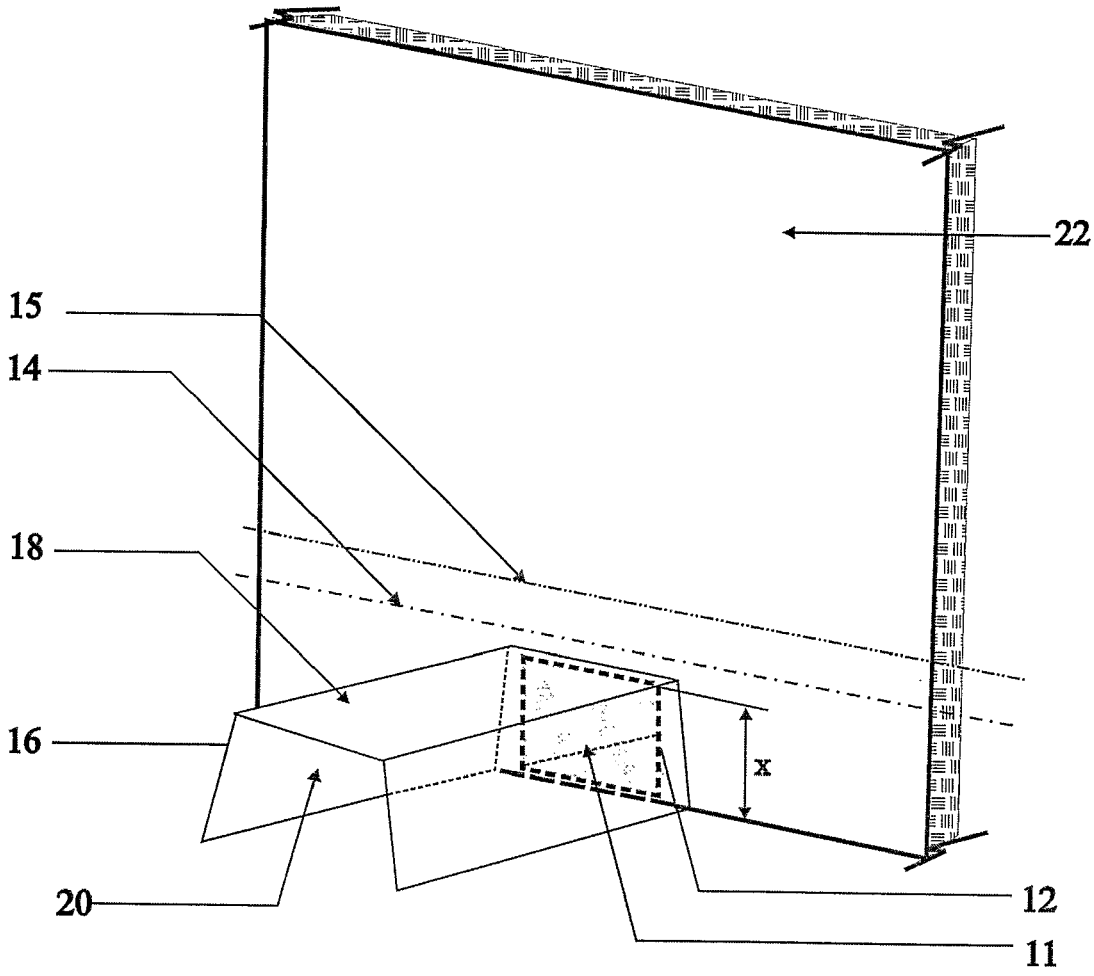
FIG. 4 shows the perspective view of an alternative canopy and draft tube arrangement for a sump in which the canopy and the draft tube are different elements.

The canopy 16 can be integral with the draft tube or the canopy and the draft tube can be separate elements as seen in FIG. 3. Furthermore, the canopy can be either fitted to the draft tube or to the wall of the sump defining the opening as seen in the remaining figures. In any event, the canopy extends from the wall 22 of the sump 10 in which the opening 11 is defined.

Figure 5:
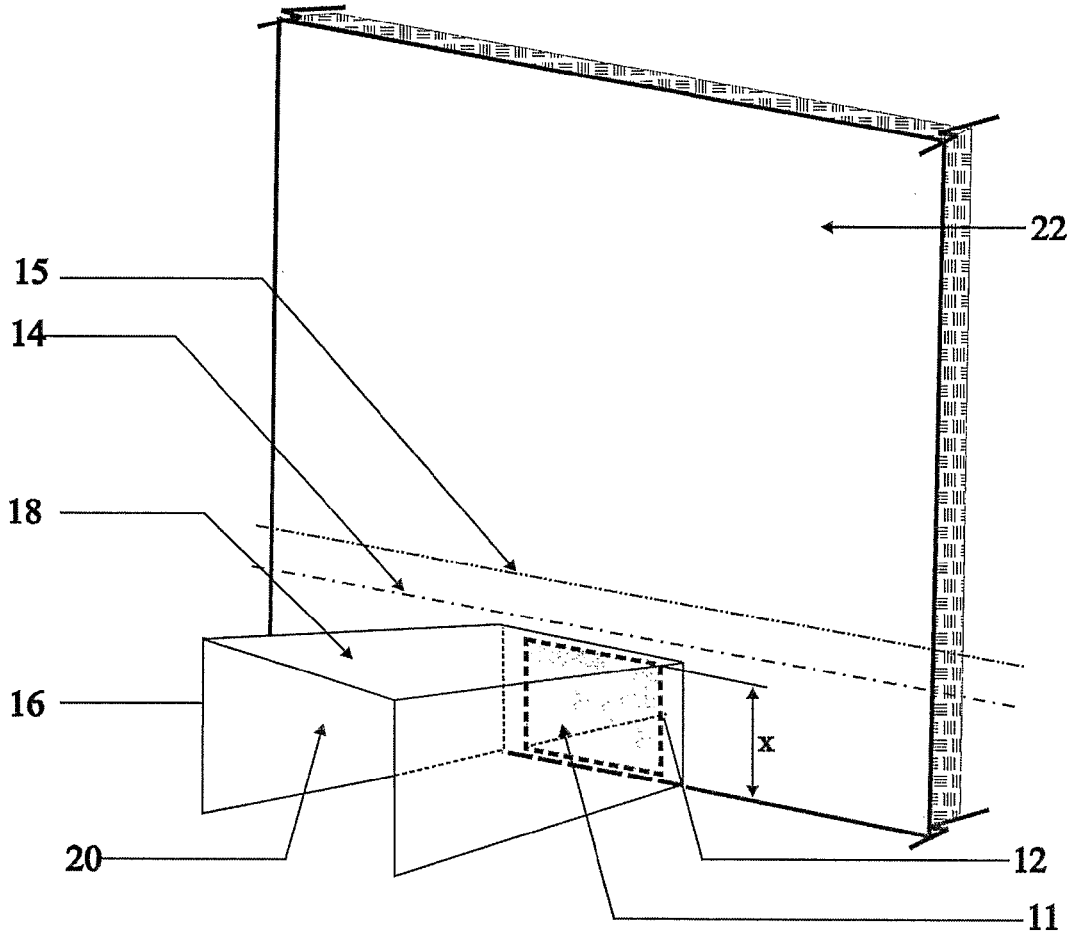
FIG. 5 shows the perspective view of yet another alternative canopy and draft tube arrangement for a sump.

The canopy (16) may be in the form of a straight plate, an arcuate plate/formation or a C-shaped plate. The canopy may be made of materials which can include; metal meshed reinforced ferro concrete, cast in-situ with ferro concrete, mild steel (all grades), stainless steel 316 and the like. The canopy (16) can also be retro fitted with the draft tube (12). The canopy (16) is defined by a roof (18) and sidewalls (20). As shown in the figures the roof (18) may be rectangular or trapezoidal in plan. As shown in FIG. 5, the sidewalls (20) may be perpendicular to the roof or inclined to the roof (18). Typically, the angle at which the sidewalls (20) are positioned ranges from 10°-20°.

Figure 2:
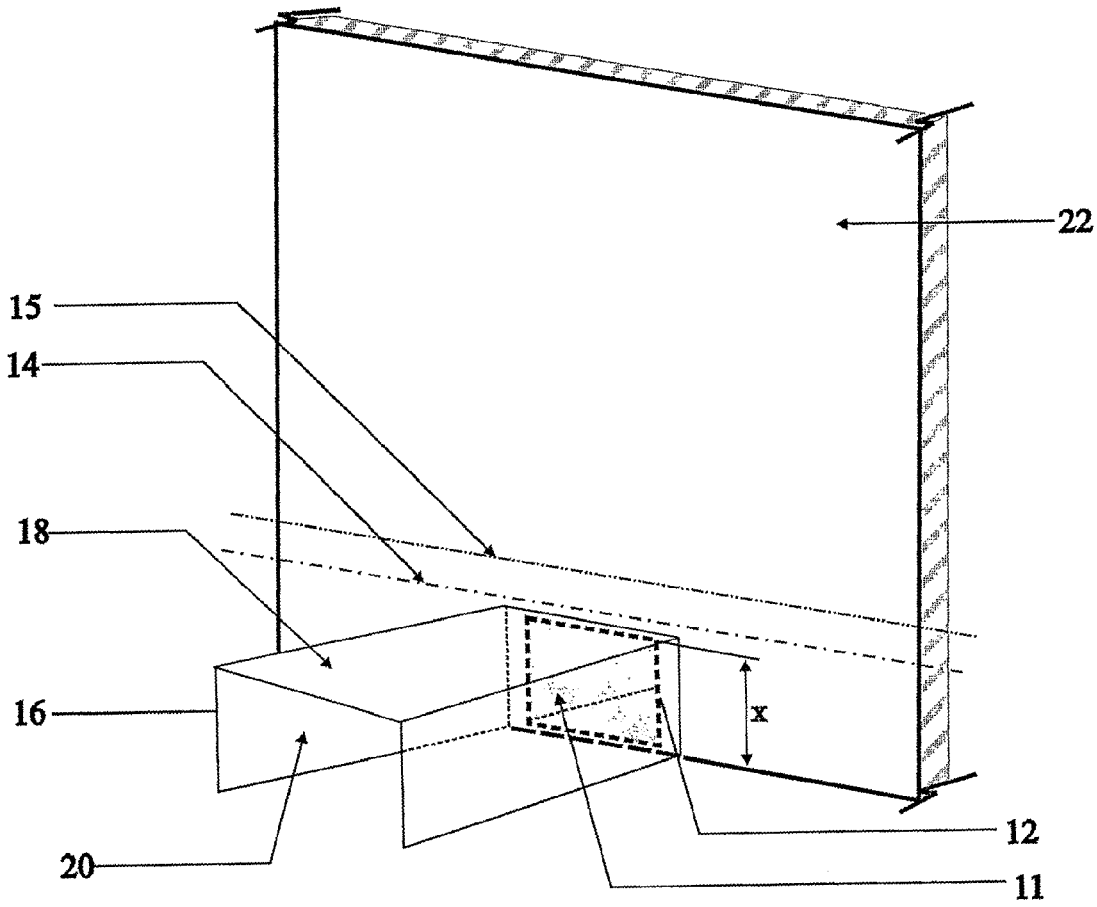
FIG. 2 shows the perspective view of a canopy and draft tube for the arrangement of FIG. 1.

As shown in FIGS. 2 and 3, the roof 18 of the canopy (16) is positioned at a height ranging from 'x' to '1.2x' from the bed of the sump, typically at the height 'x' and the operative horizontal distance to which the canopy (16) extends ranges from '½ x' to '3.0 x'. Further, the roof (18) can be at an angle of 0°-30° to the operative horizontal. However, there is a significant improvement in avoiding the air entrainment entering the draft tube (12) when the roof (18) is kept at an angle between 5 to 30 degrees with an optimum between 10 and 20 degrees. When the roof is inclined upwards, the air bubbles formed are trapped in the incline of the roof and slide down the inclined roof thus delaying entry into the draft tube as a result of which the critical submergence level is lowered.

The present invention will now be explained with respect to the examples mentioned hereunder, which do not limit the invention, but only exemplifies the same.

EXAMPLE 1

An arrangement for pumping water was provided in a sump. The sump consisted of a reservoir having height 1.43 m, length 9 m & width 0.55 m. A suction pump having capacity 52.5 lps was employed. The pump was installed at a level close to the base of the sump. A draft tube with outlet diameter 0.145 m (inlet being rectangular having cross section 0.427 m×0.187 m) was used. The effective maximum height of the opening of the draft tube in the sump was 0.188 m Water was filled in the reservoir till a level of 1.4 m. The pump was run at duty flow. It was observed that the air entrainment in the form of bubbles and voids started forming and entering the draft tube when the submergence level (critical submergence level) reached at 0.78 m. At this stage the pump was switched off.

EXAMPLE 2

An arrangement as described in example 1 was employed. A canopy was positioned at a height of 0.188 m from the bed of the sump with the roof at an angle of 0° to the operative horizontal and the canopy extended at an operative horizontal distance of 0.2 m. The pump was run at the same rpm as in example 1. It was observed that air entrainment in the form of bubbles and voids started entering at a lower submergence level of 0.715 m.

EXAMPLE 3

An arrangement as described in example 2 was employed. The canopy had a rectangular roof and the sidewalls perpendicular to the roof was positioned at a height of 0.2 m from the bed of the sump at an operative horizontal angle of 10° and the canopy extended at an operatively horizontal distance of 0.2 m. It was observed that the air entrainment in the form of bubbles and voids started entering at a submergence level of 0.71 m.

EXAMPLE 4

An arrangement as described in example 2 was employed. The canopy had a rectangular roof and the sidewalls perpendicular to the roof was positioned at a height of 0.2 m from the bed of the sump at an operative horizontal angle of 12° and the canopy extended at an operatively horizontal distance of 0.3 m. It was observed that the air entrainment in the form of bubbles and voids started entering at a submergence level of 0.705 m.

EXAMPLE 5

An arrangement as described in example 2 was employed. The canopy had a rectangular roof and the sidewalls at an angle of 15° to the roof. The roof was positioned at a height of 0.21 m from the bed of the sump at an operative horizontal angle of 15° and the canopy extended at an operatively horizontal distance of 0.3 m. It was observed that the air entrainment in the form of bubbles and voids started entering at a submergence level of 0.70 m.

EXAMPLE 6

An arrangement as described in example 2 was employed. The canopy had a trapezoidal roof and the sidewalls at an angle of to the roof. The roof was positioned at a height of 0.21 m from the bed of the sump at an operative horizontal angle of 20° and the canopy extended at an operatively horizontal distance of 0.425 m. It was observed that the air entrainment in the form of bubbles and voids started entering at a submergence level of 0.625 m.

EXAMPLE 7

An arrangement as described in example 2 was employed. The canopy had a rectangular roof and the sidewalls at an angle of 15° to the roof. The roof was positioned at a height of 0.2 m from the bed of the sump at an operative horizontal angle of 15° and the canopy extended at an operatively horizontal distance of 0.35 m. It was observed that the air entrainment in the form of bubbles and voids started entering at a submergence level of 0.66 m.

EXAMPLE 8

An arrangement as described in example 2 was employed. The canopy had a trapezoidal roof and the sidewalls at an angle of 10° to the roof. The roof was positioned at a height of 0.188 m from the bed of the sump at an operative horizontal angle of 15° and the canopy extended at an operatively horizontal distance of 0.35 m. It was observed that the air entrainment in the form of bubbles and voids started entering at a submergence level of 0.69 m.

It can thus be seen that changing the angle of inclination of the canopy roof and the side walls and placing the canopy at an effective height with respect to the maximum opening height has an effect on the critical submergence level. By lowering the critical submergence level, effectively more water could be pumped out of the sump.

While considerable emphasis has been placed herein on the particular features of the preferred embodiment and the improvisation with regards to it, it will be appreciated that various modifications can be made in the preferred embodiments without departing from the principles of the invention. These and the other modifications in the nature of the invention will be apparent to those skilled in art from disclosure herein, whereby it is to be distinctly understood that the foregoing descriptive matter is to interpreted merely as illustrative of the invention and not as a limitation.

The invention claimed is:

1. An arrangement for drawing fluid from a sump, comprising a pump, a draft tube extending from the pump into the sump, said draft tube having an opening within the sump, said opening has a maximum height of 'x' above a bed of the sump and a canopy defined by a roof and side walls surrounding said opening, said canopy being fixed and non-rotatable with respect to the side walls, said canopy extends to a distance of at least 0.5 x into the sump and a height of the roof of said canopy as measured from the base of the sump ranges between x and 1.2 x, wherein the roof of said canopy is defined in a plane which is at an angle from about 5° to about 30° with respect approximately to the plane of the sump bed, parallel to the sump bed.

2. An arrangement as claimed in claim 1, wherein the canopy extends to a distance between 0.5x and 3x into the sump.

3. An arrangement as claimed in claim 1, wherein the canopy is integral with the draft tube.

4. An arrangement as claimed in claim 1, wherein the canopy and the draft tube are separate elements.

5. An arrangement as claimed in claim 1, wherein the canopy is either fitted to the draft tube or to the wall of the sump defining the opening.

6. An arrangement as claimed in claim 1, wherein the canopy extends from the wall of the sump in which the opening is defined.

7. An arrangement as claimed in claim 1, wherein the side walls are parallel or inclined to the roof.

8. An arrangement as claimed in claim wherein the roof and side walls are rectangular or trapezoidal elements.

9. A draft tube for a pump for drawing liquids from a pump, wherein the draft tube comprises a canopy defined by a roof and side walls adapted to extend into a sump up to a distance of 0.5x to 3x, where x represents the maximum height of an opening of the draft tube from the sump bed and the roof has a height ranging from x to 1.2x, said canopy being fixed and non-rotatable with respect to the side walls, wherein the roof of said canopy is defined in a plane which is at an angle from about 5° to about 30° with respect approximately to the plane of the sump bed, parallel to the sump bed.

10. An arrangement as claimed in claim 1, wherein the angle of the roof of said canopy is from about 10° to about 20°.

* * * * *